US007905074B1

(12) United States Patent
Gess

(10) Patent No.: US 7,905,074 B1
(45) Date of Patent: Mar. 15, 2011

(54) APPARATUS AND METHOD FOR THE AUTOMATED MANUFACTURE OF SELF-SEALING INFLATABLE DUNNAGE BAGS

(75) Inventor: Larry C. Gess, Palmyra, WI (US)

(73) Assignee: Ivex Protective Packaging, Inc., Bridgeview, IL (US)

( * ) Notice: Subject to any disclaimer, the term of this patent is extended or adjusted under 35 U.S.C. 154(b) by 0 days.

(21) Appl. No.: 12/768,946

(22) Filed: Apr. 28, 2010

Related U.S. Application Data

(60) Provisional application No. 61/174,544, filed on May 1, 2009.

(51) Int. Cl.
*B65B 31/00* (2006.01)

(52) U.S. Cl. ..... 53/403; 53/511; 137/846; 137/512.15; 383/58

(58) Field of Classification Search ..... 53/403, 53/433, 511; 137/846, 849, 844, 512.15, 137/512.4; 383/3, 44, 57, 58, 48, 98, 100, 383/103; 493/266
See application file for complete search history.

(56) References Cited

U.S. PATENT DOCUMENTS

| | | | | | |
|---|---|---|---|---|---|
| 3,180,558 | A | * | 4/1965 | Quaadgras et al. | 383/58 |
| 3,207,420 | A | * | 9/1965 | Navarrete-Kindelan | 383/38 |
| 4,076,872 | A | * | 2/1978 | Lewicki et al. | 428/12 |
| 4,917,646 | A | * | 4/1990 | Kieves | 446/224 |
| 4,983,138 | A | * | 1/1991 | McGrath | 446/224 |
| 5,351,828 | A | | 10/1994 | Becker et al. | |
| 5,447,235 | A | | 9/1995 | Pharo | |
| 5,832,698 | A | * | 11/1998 | Huguenin | 53/451 |
| 5,860,441 | A | * | 1/1999 | Garcia | 137/15.18 |
| 6,015,047 | A | * | 1/2000 | Greenland | 206/522 |
| 7,311,442 | B1 | * | 12/2007 | Moravek | 383/45 |
| 7,444,795 | B2 | | 11/2008 | Yasuhira | |

* cited by examiner

*Primary Examiner* — Thanh K Truong
(74) *Attorney, Agent, or Firm* — Donald J. Ersler

(57) ABSTRACT

An apparatus and method for the automated manufacture of self-sealing inflatable dunnage bags includes a bag making machine. The bag making machine includes a plurality of sheet roll spindles and a plurality of heat sealing rollers. A first bag sheet roll is retained on a first bag spindle. A second bag sheet roll is retained on a second bag spindle. A strip bag sheet roll is retained on a strip spindle. A plurality of first openings are formed through the first bag sheet. A plurality of second openings are formed through the strip bag sheet. Each edge of the strip bag sheet is heat sealed to the first bag sheet with a first roller. A first bag roller seals an end partition across the first and second bag sheets. The edges of the first and second bag sheet are heat sealed to each other with a second bag roller.

20 Claims, 4 Drawing Sheets

APPARATUS AND METHOD FOR THE AUTOMATED MANUFACTURE OF SELF-SEALING INFLATABLE DUNNAGE BAGS

CROSS-REFERENCES TO RELATED APPLICATIONS

This is a utility patent application taking priority from provisional application No. 61/174,544 filed on May 1, 2009.

BACKGROUND OF THE INVENTION

1. Field of the Invention

The present invention relates generally to inflatable bags and more specifically to an apparatus and method for the automated manufacture of self-sealing inflatable dunnage bags, which greatly reduces the complexity of the inflatable bag.

2. Discussion of the Prior Art

It is well known in the art of inflatable dunnage bags to fill a bag structure with air and then heat seal the bag to retain the air therein. However, the dunnage bag is typically complicated or the machinery used to produce and fill the dunnage bag with air is also complicated. A complicated dunnage bag will require complicated machinery to fill thereof. A complicated dunnage bag inflation machine will not always produce a consistent product, due to the complexity of the machine and also variations in the sheet material used to produce the dunnage bag.

Typically, a manufacturer of inflatable dunnage bags provides a customer with bag filling machines at no cost and sells the inflatable dunnage bags to the customer. Any problems with the bag filling machine is the manufacturer's responsibility and expense. It is to the manufacturer's advantage to have the simplest and most inexpensive bag filling machines to produce the inflatable dunnage bags. Having inexpensive bag filling machinery makes it possible to sell the inflatable dunnage bags to smaller companies.

U.S. Pat. No. 5,351,828 to Becker et al. discloses an inflatable foil sachet, especially for packaging purposes. The Becker et al. patent includes a foil sachet with at least one chamber consisting of an upper and lower foil secured together by a closed seam. In order to fill the chambers with a substance, especially air, there is a channel having channel sections opening in the region of a seam and preferably in the region of the corner of the chamber concerned where there is an aperture in said chamber.

U.S. Pat. No. 5,447,235 to Pharo discloses a bag with squeeze valve and method for packaging an article therein. The Pharo patent includes an inflatable package adapted to be formed into a packaging system for retaining an article therein is formed with a pair of overlying inner panels defining a pocket therebetween adapted to retain an article therein an inflating portion for communicating through the overlying inner panels.

U.S. Pat. No. 7,444,795 to Yasuhira discloses a gas seal-in method for a bag with a gas filling compartment and packaging method for a bag with a gas filling compartment. The Yasuhira patent includes a method of sealing-in a gas in a gas filling compartment of a bag having a cut-in formed near the upper edge of the gas filling compartment.

Accordingly, there is a clearly felt need in the art for an apparatus and method for the automated manufacture of self-sealing inflatable dunnage bags, which provides a three layer inflatable dunnage bag that may be filled without the use of complicated bag filling machinery.

SUMMARY OF THE INVENTION

The present invention provides an apparatus and method for the automated manufacture of self-sealing inflatable dunnage bags, which greatly reduces the complexity of the bag filling machinery. The apparatus and method for the automated manufacture of self-sealing inflatable dunnage bags includes a bag making machine. The bag making machine includes a plurality of sheet roll spindles and a plurality of heat sealing rollers. A first bag sheet roll is retained on a first bag spindle. A second bag sheet roll is retained on a second bag spindle. A strip bag sheet roll is retained on a strip bag spindle. A first opening is formed through the first bag sheet for each bag. The first opening is formed adjacent one end of the bag. A second opening is formed through the strip bag sheet for each bag on the opposite end of the bag. The strip bag sheet has a much smaller width than the first and second bag sheet rolls.

Substantially each edge of the strip bag sheet is heat sealed to the first bag sheet with a strip heat sealing roller. The strip bag sheet is preferably heat sealed to a middle of the first bag sheet, but other locations could be used. A first bag heat sealing roller seals an end partition across a width of the first and second bag sheets. Substantially each edge of the first and second bag sheets are heat sealed to each other with a second bag heat sealing roller, such that the strip bag sheet is retained therebetween to form a plurality of inflatable bags. A perforation roller may be used to create a bag separation perforation in each end partition or a slitting knife may be used to separate the plurality of dunnage bags. The plurality of dunnage bags may be inflated using an air hose or any suitable bag filling machinery or device.

Accordingly, it is an object of the present invention to provide an apparatus and method for the automated manufacture of self-sealing inflatable dunnage bags, which provides a three layer dunnage bag that may be self-sealed without a complicated sealing operation.

Finally, it is another object of the present invention to provide an apparatus and method for the automated manufacture of self-sealing inflatable dunnage bags, which provides an inflatable dunnage bag that may be filled without the use of complicated bag filling machinery.

These and additional objects, advantages, features and benefits of the present invention will become apparent from the following specification.

DETAILED DESCRIPTION OF THE PREFERRED EMBODIMENTS

Figure 1:
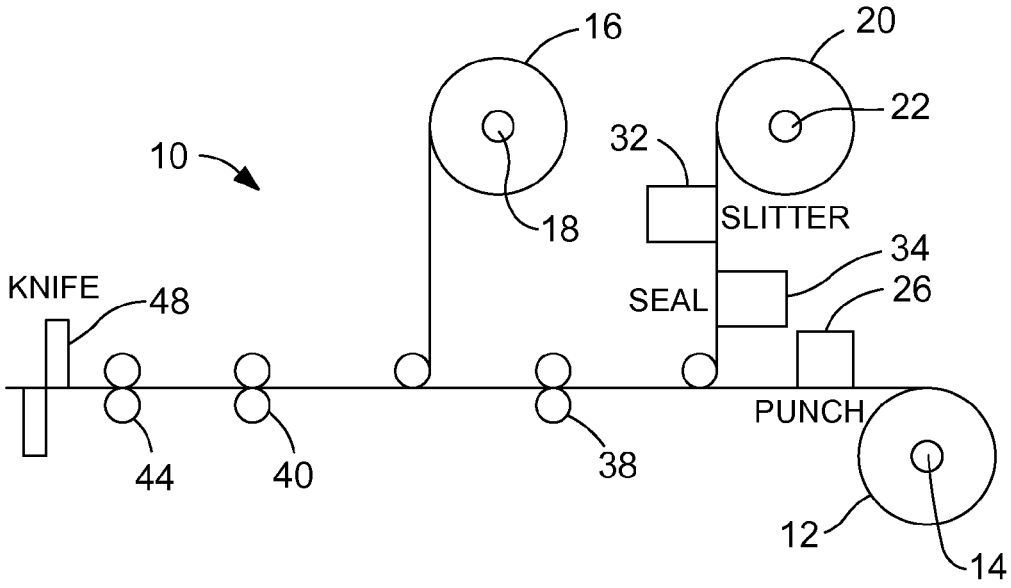
FIG. 1 is a side view of a bag making machine for the automated manufacture of self-sealing inflatable dunnage bags in accordance with the present invention.

With reference now to the drawings, and particularly to FIG. 1, there is shown a side view of a bag making machine 10. The bag making machine 10 includes a plurality of sheet roll spindles and a plurality of heat sealing rollers. A first bag sheet 12 as a roll is retained on a first bag spindle 14. A second bag sheet 16 as a roll is retained on a second bag spindle 18. A strip bag sheet 20 as a roll is retained on a strip spindle 22. The plurality of sheets are preferably fabricated from plastic sheeting.

Figure 2:
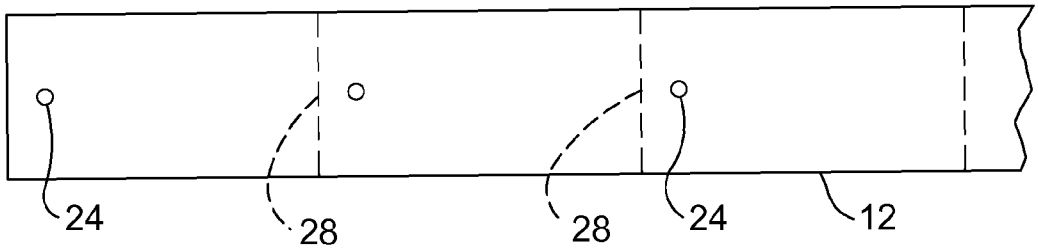
FIG. 2 is a top view of a first bag sheet with a plurality of first openings formed on a bag making machine in accordance with the present invention.

With reference to FIG. 2, a first opening 24 is formed through the first bag sheet 12 for each bag. The first opening 24 is formed adjacent to one end of every bag. The first opening 24 is created with an automated punch 26 or the like. The first opening 24 could be a hole, a slit or any other suitable opening. A theoretical dashed division line 28 is shown to illustrate the length of each bag on the first bag sheet 12.

Figure 3:
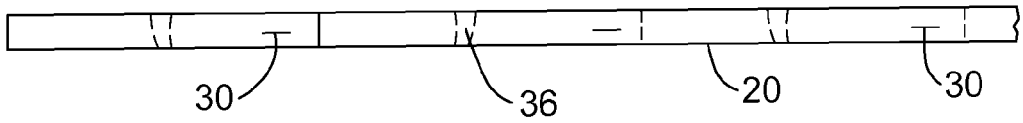
FIG. 3 is a top view of a strip bag sheet with a plurality of second openings formed on a bag making machine in accordance with the present invention.

With reference to FIG. 3, a second opening 30 is formed through the strip bag sheet 20 for each bag on the opposite end of every bag. The strip bag sheet 20 has a much smaller width than the first or second bag sheet rolls. The width of the strip bag sheet 20 is preferably less than one third of the width of the first bag sheet 12. The second opening 30 is preferably created with an automated slitter 32 or the like. The second opening 30 could be a slit, a hole or any other suitable opening.

An optional sealant application device 34 may be used to ensure a seal between the first bag sheet 12 and the strip bag sheet 20. The sealant application device 34 would preferably apply a sealant substance 36 to an underside of the strip bag sheet 20 between the first opening 24 and the second opening 30, but could be applied to the first bag sheet 12. The sealant substance 36 could also be applied around a perimeter of the first or second openings. The sealant substance 36 seals the first bag sheet 12 to the strip bag sheet 20 to prevent air from leaking out of the first opening 24. The sealant substance 36 is preferably a substance or liquid with removable adhesive, tacky or sticky properties. Substances or liquids with the removable adhesive, tacky or sticky properties include vaseline, oil, water, liquid soap, soapy water or any other suitable substance.

Figure 4:
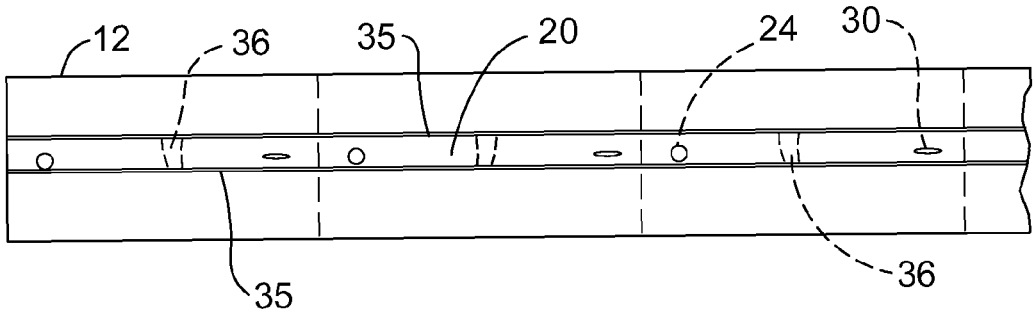
FIG. 4 is a top view of a strip bag sheet heat sealed to a first bag sheet on a bag making machine in accordance with the present invention.
Figure 5:
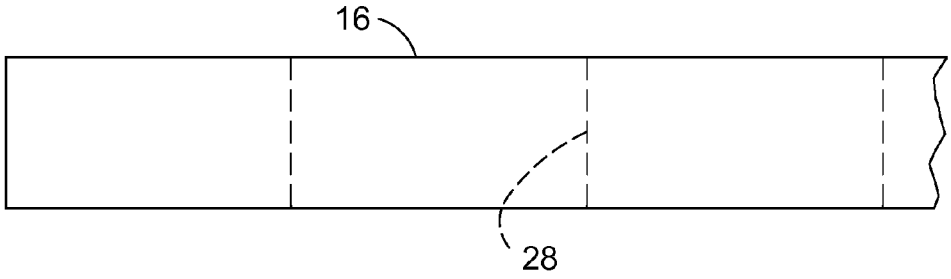
FIG. 5 is a top view of a second bag sheet in accordance with the present invention.
Figure 8:
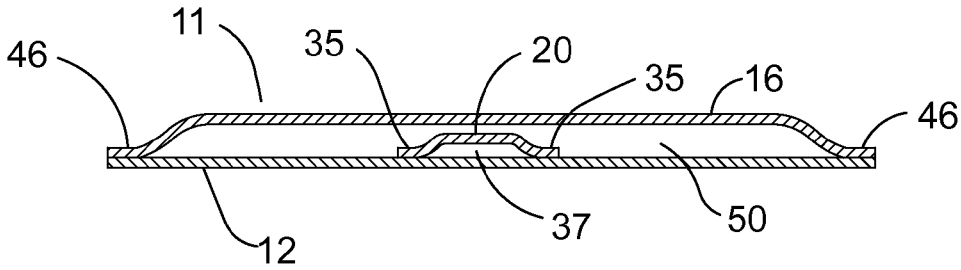
FIG. 8 is an enlarged cross sectional view of a dunnage bag formed on a bag making machine in accordance with the present invention.

With reference to FIG. 4, substantially each edge of the strip bag sheet 20 is heat sealed to the first bag sheet 12 with a strip heat sealing roller 38 to form a pair of substantial strip edge seals 35. With reference to FIG. 8, an air channel 37 is formed between the pair of substantial strip edge seals 35. The strip bag sheet 20 is preferably heat sealed to a middle of the first bag sheet 12, but other locations could also be used. With reference to FIG. 5, the second bag sheet 16 includes the plurality of theoretical dashed division line 28 to illustrate the length of each bag on the second bag sheet 16.

Figure 6:
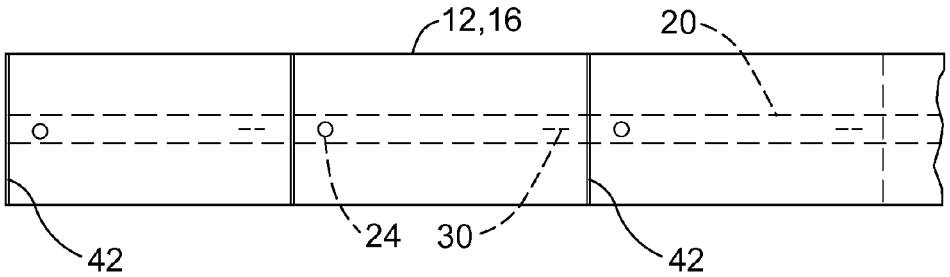
FIG. 6 is a top view of a second bag sheet heat sealed to a first bag sheet to form a plurality of end partitions on a bag making machine in accordance with the present invention.
Figure 7:
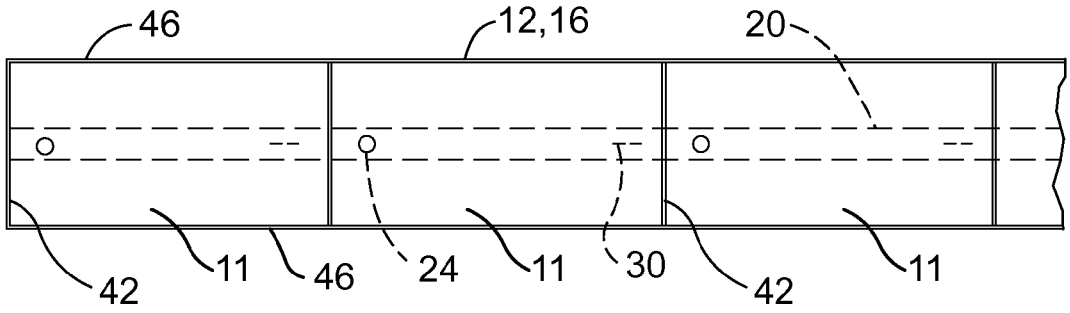
FIG. 7 is a top view of a second bag sheet heat sealed to a first bag sheet to form a plurality of dunnage bags on a bag making machine in accordance with the present invention.

With reference to FIG. 6, a first bag heat sealing roller 40 seals an end partition 42 across a width of the first and second bag sheets. With reference to FIG. 7, substantially each edge of the first and second bag sheets are heat sealed to each other with a second bag heat sealing roller 44 to form a pair of substantial edge seals 46, such that the strip bag sheet 20 is retained therebetween to form a plurality of inflatable bags 11. A bag cavity 50 is formed inside the two end partitions 42 and the pair of substantial edge seals 46. A perforation roller (not shown) may be used to create a bag separation perforation in each end partition 42 or a slitting knife 48 may be used to separate the plurality of inflatable bags 11.

Heat sealing rollers 38, 40, 44 have been disclosed as the method for sealing strip bag sheet 20 to the first bag sheet 12 and the first bag sheet 12 to the second bag sheet 20. However, the manufacture of the inflatable bags 11 should not be limited to assembly by heat sealing alone, but should include sealing through glue, adhesive, cement or any other suitable sealing method. Sealing with glue, adhesive or cement would include applying a strip of glue, adhesive or cement to at least one sheet to be sealed and pressing the two sheets together to form the seal. The application of the glue, adhesive or cement would be applied with any suitable manufacturer method or process. The glue, adhesive or cement includes ultra-violet cured glue, adhesive and cement.

With reference to FIG. 8, the plurality of inflatable bags 11 are inflated by blowing air into the first air opening 24. The air introduced through the first air opening 24 flows through the air channel 37 to the second air opening 30 and into the bag cavity 50 formed between the first and second bag sheets. Air pressure forces the strip bag sheet 20 downward against the first bag sheet 12 to form a contact seal. The optional use of the sealant 36 insures that the seal is formed for inflatable bags 11 having a shorter length. The plurality of inflatable bags 11 may be inflated through an air hose or any suitable automatic inflation device.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method for the automated manufacture of self-sealing inflatable bags, comprising the steps of:

providing a first bag sheet, forming a plurality of first openings through said first bag sheet;

providing a second bag sheet;

providing a strip bag sheet having a first lengthwise edge and a second lengthwise edge, forming a plurality of second openings through said strip bag sheet;

sealing an entire length of said first lengthwise edge to said first bag sheet, sealing an entire length of said second lengthwise edge to said first bag sheet, an air channel is formed between said strip bag sheet and said first bag sheet, said plurality of first holes communicating with said plurality of said second openings through said air channel;

sealing a plurality of end partitions across a width of said first bag sheet, said second bag sheet and said strip bag sheet, wherein said air channel is sealed on each end thereof for each one of the plurality of bags; and sealing lengthwise edges of said first bag sheet to lengthwise edges of a second bag sheet to form the plurality of inflatable bags.

2. The method for the automated manufacture of self-sealing inflatable bags of claim 1, further comprising the step of:

forming said first opening adjacent one end of each one of the plurality of inflatable bags, forming said second opening adjacent the other end of each one of the plurality of inflatable bags.

3. The method for the automated manufacture of self-sealing inflatable bags of claim 2, further comprising the step of:

defining each one said first and second openings as one of a hole and a slit.

4. The method for the automated manufacture of self-sealing inflatable bags of claim 1, further comprising the step of:

applying a sealant substance between said strip bag sheet and said first bag sheet, said sealant substance having at least one of the properties of removable adhesive, tacky or sticky.

5. The method for the automated manufacture of self-sealing inflatable bags of claim 4, further comprising the step of:

applying said sealant substance to at least one of around a perimeter of at least one said first and second openings and between said first and second openings.

6. The method for the automated manufacture of self-sealing inflatable bags of claim 1, further comprising the step of:

providing a strip heat sealing roller to seal said strip bag sheet to said first bag sheet.

7. The method for the automated manufacture of self-sealing inflatable bags of claim 1, further comprising the step of:

providing a first bag heat sealing roller for sealing a plurality of end partitions across a width of said first and second bag sheets.

8. The method for the automated manufacture of self-sealing inflatable bags of claim 1, further comprising the step of:

providing a second bag heat sealing roller for sealing said edges of said first and second bag sheets together.

9. The method for the automated manufacture of self-sealing inflatable bags of claim 1, further comprising the step of:

sealing said bag sheets together with one of a glue, adhesive and cement.

10. A method for the automated manufacture of self-sealing inflatable bags, comprising the steps of:

providing a first bag sheet having a first lengthwise edge and a second lengthwise edge, forming a plurality of first openings through said first bag sheet;

providing a second bag sheet;

providing a strip bag sheet, forming a plurality of second openings through said strip bag sheet;

sealing an entire length of said first lengthwise edge to said first bag sheet, sealing an entire length of said second lengthwise edge to said first bag sheet, an air channel is formed between said strip bag sheet and said first bag sheet, said plurality of first holes communicating with said plurality of said second openings through said air channel, perimeters of said plurality of first openings do not intersect or cover perimeters of said plurality of second openings;

sealing a plurality of end partitions across a width of said first bag sheet, said second bag sheet and said strip bag sheet, wherein said air channel is sealed on each end thereof for each one of the plurality of bags; and sealing lengthwise edges of said first bag sheet to lengthwise edges of a second bag sheet to form the plurality of inflatable bags.

11. The method for the automated manufacture of self-sealing inflatable bags of claim 10, further comprising the step of:

forming said first opening adjacent one end of each one of the plurality of inflatable bags, forming said second opening adjacent the other end of each one of the plurality of inflatable bags.

12. The method for the automated manufacture of self-sealing inflatable bags of claim 11, further comprising the step of:

defining each one said first and second openings as one of a hole and a slit.

13. The method for the automated manufacture of self-sealing inflatable bags of claim 10, further comprising the step of:

applying a sealant substance between said strip bag sheet and said first bag sheet, said sealant substance having at least one of the properties of removable adhesive, tacky or sticky.

14. The method for the automated manufacture of self-sealing inflatable bags of claim 13, further comprising the step of:

applying said sealant substance to at least one of around a perimeter of at least one said first and second openings and between said first and second openings.

15. The method for the automated manufacture of self-sealing inflatable bags of claim 10, further comprising the step of:

providing a strip heat sealing roller to seal said strip bag sheet to said first bag sheet.

16. The method for the automated manufacture of self-sealing inflatable bags of claim 10, further comprising the step of:

providing a first bag heat sealing roller for sealing a plurality of end partitions across a width of said first and second bag sheets.

17. The method for the automated manufacture of self-sealing inflatable bags of claim 10, further comprising the step of:

providing a second bag heat sealing roller for sealing said edges of said first and second bag sheets together.

18. The method for the automated manufacture of self-sealing inflatable bags of claim 10, further comprising the step of:

sealing said bag sheets together with one of a glue, adhesive and cement.

19. A method for the automated manufacture of self-sealing inflatable bags, comprising the steps of:

providing a first bag sheet having a first lengthwise edge and a second lengthwise edge, forming a plurality of first openings through said first bag sheet;

providing a second bag sheet;

providing a strip bag sheet, forming a plurality of second openings through said strip bag sheet;

applying a sealant substance between said strip bag sheet and said first bag sheet, said sealant substance having at least one of the properties of removable adhesive, tacky or stick;

sealing an entire length of said first lengthwise edge to said first bag sheet, sealing an entire length of said second lengthwise edge to said first bag sheet, an air channel is formed between said strip bag sheet and said first bag sheet, said plurality of first holes communicating with said plurality of said second openings through said air channel, perimeters of said plurality of first openings do not intersect or cover perimeters of said plurality of second openings;

sealing a plurality of end partitions across a width of said first bag sheet, said second bag sheet and said strip bag sheet, wherein said air channel is sealed on each end thereof for each one of the plurality of bags; and sealing lengthwise edges of said first bag sheet to lengthwise edges of a second bag sheet to form the plurality of inflatable bags.

20. The method for the automated manufacture of self-sealing inflatable bags of claim 19, further comprising the step of:

applying said sealant substance to at least one of around a perimeter of at least one said first and second openings and between said first and second openings.

* * * * *